United States Patent [19]

Bennett

[11] 3,965,835

[45] June 29, 1976

[54] ARCTIC TRANSPORT AND MARINE OPERATION SYSTEM

[75] Inventor: John D. Bennett, Denton, Tex.

[73] Assignee: Sun Oil Company, Dallas, Tex.

[22] Filed: Mar. 28, 1974

[21] Appl. No.: 455,820

[52] U.S. Cl. ..... 114/42

[51] Int. Cl.[2] ..... B63B 35/12

[58] Field of Search ..... 114/40, 41, 42; 115/20, 115/19

[56] References Cited

UNITED STATES PATENTS

| | | | |
|---|---|---|---|
| 958 | 10/1838 | Hunt et al. | 114/40 |
| 271,203 | 1/1883 | Lowe | 115/20 |
| 1,905,345 | 4/1933 | Dandini | 115/20 |
| 2,665,655 | 1/1954 | Brown et al. | 114/42 |
| 3,009,434 | 11/1961 | Cushman | 114/40 |
| 3,766,737 | 10/1973 | Howard | 114/42 |

FOREIGN PATENTS OR APPLICATIONS

| | | | |
|---|---|---|---|
| 1,204,548 | 11/1965 | Germany | 114/42 |

*Primary Examiner*—Trygve M. Blix
*Assistant Examiner*—Gregory W. O'Connor
*Attorney, Agent, or Firm*—George L. Church; Donald R. Johnson; Macka L. Murrah

[57] ABSTRACT

A buoyant, cylindrical metal drum, having a plurality of elongate teeth protruding outwardly from the periphery thereof is mounted for rotation about its longitudinal axis in a generally U-shaped framework. The frame is pivotally attached to the front of a tug vessel and the drum may be steered, with respect to the boat, by moving the mounting frame about the pivot point. An internal power source and an eccentric counterweight, which may include a fuel storage container for the power source, are stationarily mounted within the drum which is rotated about the counterweight as an inertial reference. When the drum is rotated by its internal power source and moved against the water/ice interface of a floating arctic ice sheet, the moving teeth on the drum cut the ice and clear a path for movement of the drum and the tug boat through the ice covered water. In an embodiment of the invention wherein substantial heat is generated by the drum power source, for example where a gas turbine engine is employed, the heat is preferably directed into the region surrounding the drum and in front of the tug to prevent the cut ice from immediately refreezing upon contact with the sub-zero air temperatures.

The tug mounted rotating cutter can be used to tow a drilling rig in arctic waters, and subsequently operated to cut an annular channel around the resulting "ice island" to isolate the rig from the movement of the surrounding ice sheet.

2 Claims, 6 Drawing Figures

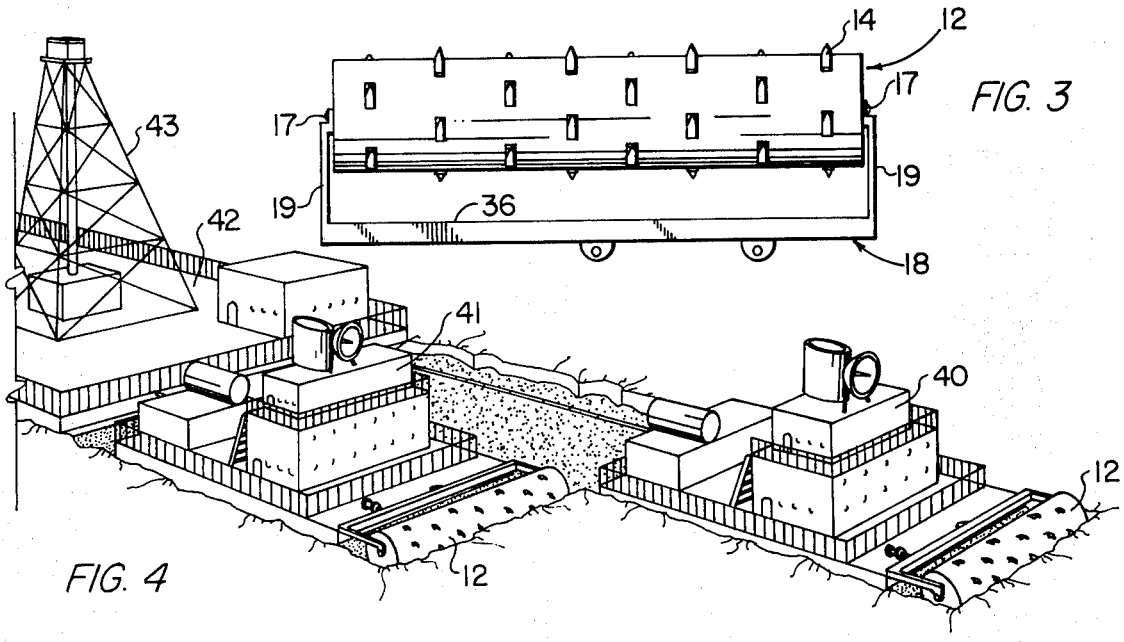
FIG. 3
FIG. 4
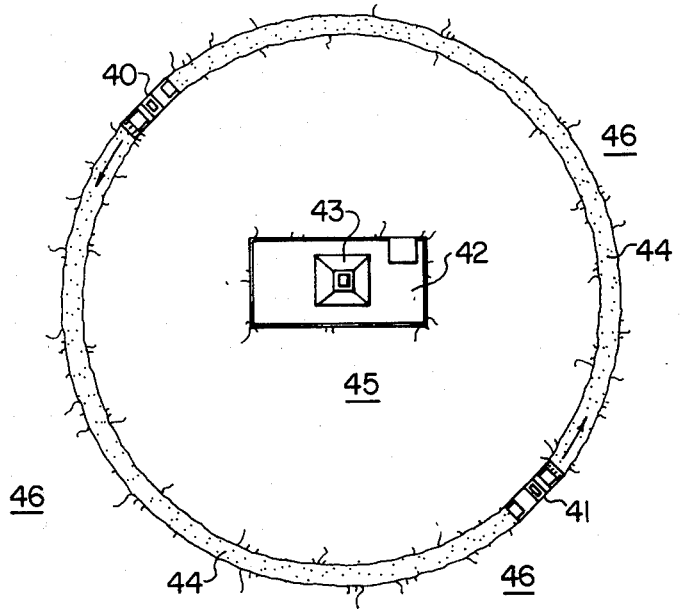
FIG. 5
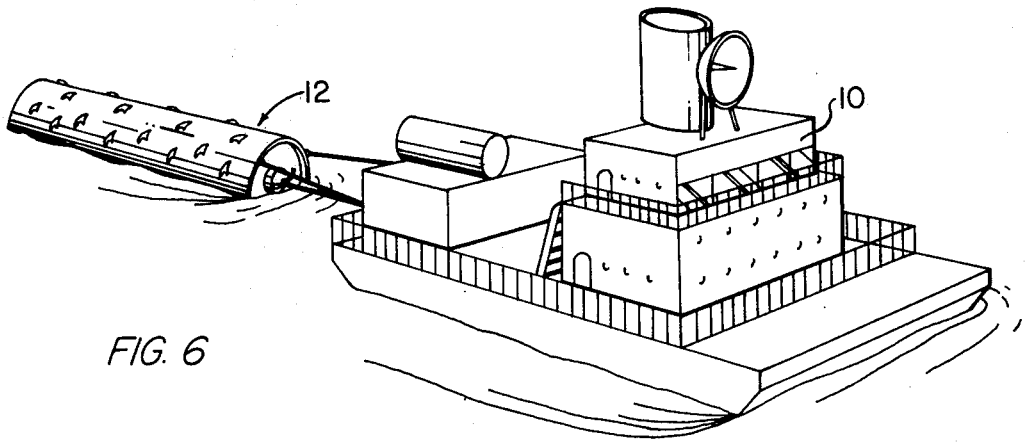
FIG. 6

ARCTIC TRANSPORT AND MARINE OPERATION SYSTEM

BACKGROUND OF THE INVENTION

The invention relates to arctic marine transportation systems and, more particularly, to a system for forming a path through a sheet of frozen ice in order to move equipment, such as a marine operations barge, therethrough.

In the past, the principle way in which movement has been managed through frozen arctic waters is by means of ships known as "ice breakers". These ice breakers rely upon the weight of the ship and a reinforced ballast section so that as the engines of the ship drive the bow up onto the surface of the ice the weight of the ship crushes the ice beneath to form a pathway therethrough. Such ice breaking ships are extremely expensive and can only operate in ice fields wherein the ice is no thicker than that for which the ship was designed.

Various proposals, such as that shown in U.S. Pat. No. 2,665,655, have been made for the design of cutting mechanisms which are attached to the front of a ship and driven by power from the ship to saw or grind the ice and form a path therethrough ahead of the ship. Some of the reasons why such systems have not proven practical are that it is very difficult to steer mechanisms powered from the deck of a ship or to cut ice of a thickness often found in the arctic regions without damaging conventional equipment. None of these prior art systems incorporate a floating drum which is driven by a self-contained power source to cut the ice sheet and form a path in advance of a ship.

Many proposals have been made of different techniques for performing marine operations in the arctic regions, such as drilling oil and gas wells, but most of these techniques have proven to be impractical. For example, offshore drilling platforms and equipment located in the arctic ice fields cannot withstand movement of the polar ice pack which is present during much of the arctic year. Similarly, self propelled drilling vessels which are maintained in floating position over a well can be used only during the ice-free portion of the arctic season which is relatively short. In U.S. Pat. No. 3,749,162 to Anders there is disclosed a system for maintaining a drilling barge at a fixed position above a well and floating within a moving pool of water upon the surface of the ice by melting the pool wall in the opposite direction from movement of the ice. Other more exotic approaches such as a drilling barge suspended by air cushions (ground effect operation) above the surface of the ice have also been proposed. Each of these prior art systems possess inherent disadvantages which are overcome by the present method of freezing a drilling barge into place and continuously cutting an annular channel circumferentially around the barge to free it from movement due to that of the surrounding ice sheet.

SUMMARY OF THE INVENTION

The invention relates to a system for forming a channel through an arctic ice sheet which includes a horizontally disposed floating drum having a plurality of elongate teeth thereon. The drum is rotated by a self-contained power source to cut the ice sheet and clear a path for movement of the drum and vessel through ice covered water.

In another aspect, the present system of the invention includes a horizontally disposed and rotatable buoyant drum having an internal counterweight. The drum is steerably attached to the front of a vessel and includes a plurality of outwardly projecting teeth and an internal power source for rotating the drum about the counterweight as an inertial reference. As the drum is rotated and moved against an ice sheet, the teeth cut the ice and form a path for the vessel.

A further aspect of the present invention includes a method for maintaining a marine operations barge in a generally fixed position above a submerged well by using the apparatus of the invention. In the method, a path is cleared through the ice and the operations barge is moved into location and frozen into position. The horizontal, rotating drum and vessel are then used to continuously cut an annular channel through the ice surrounding the barge to isolate it and prevent motion due to movement of the surrounding ice field.

A still further aspect of the present invention is the provision of a hollow framework with opening therein to transmit exhaust heat from the internal power source and discharge it around the teeth to inhibit re-freezing of ice pieces in the channel.

Stated more broadly, the present invention comprises a method for maintaining a floating structure in a substantially fixed position above a preselected location on an ice covered sea bottom. The method includes allowing the structure to freeze into the ice above the bottom location and then forming an annular channel around a portion of the ice surrounding the structure to isolate it from movement of the surrounding ice sheet.

BRIEF DESCRIPTION OF THE DRAWING

For a more complete understanding of the present invention and for further abjects and advantages thereof, reference may now be had to the following description taken in conjunction with the accompanying drawing, in which:

FIG. 3 is a top view of the drum and support frame shown in FIG. 1;

FIG. 4 is a perspective view of a pair of tug vessels and drums towing a drilling barge through a channel formed in an arctic ice sheet;

FIG. 5 is a top plan view of a drilling barge frozen into place and the tug mounted drums moving in a circumferential path about the rig to form an annular isolation channel and prevent movement of the rig by the surrounding ice sheet; and FIG. 6 is a perspective view of a tug vessel towing a drum through non-ice-covered waters to a location in the arctic.

DETAILED DESCRIPTION

Figure 1:
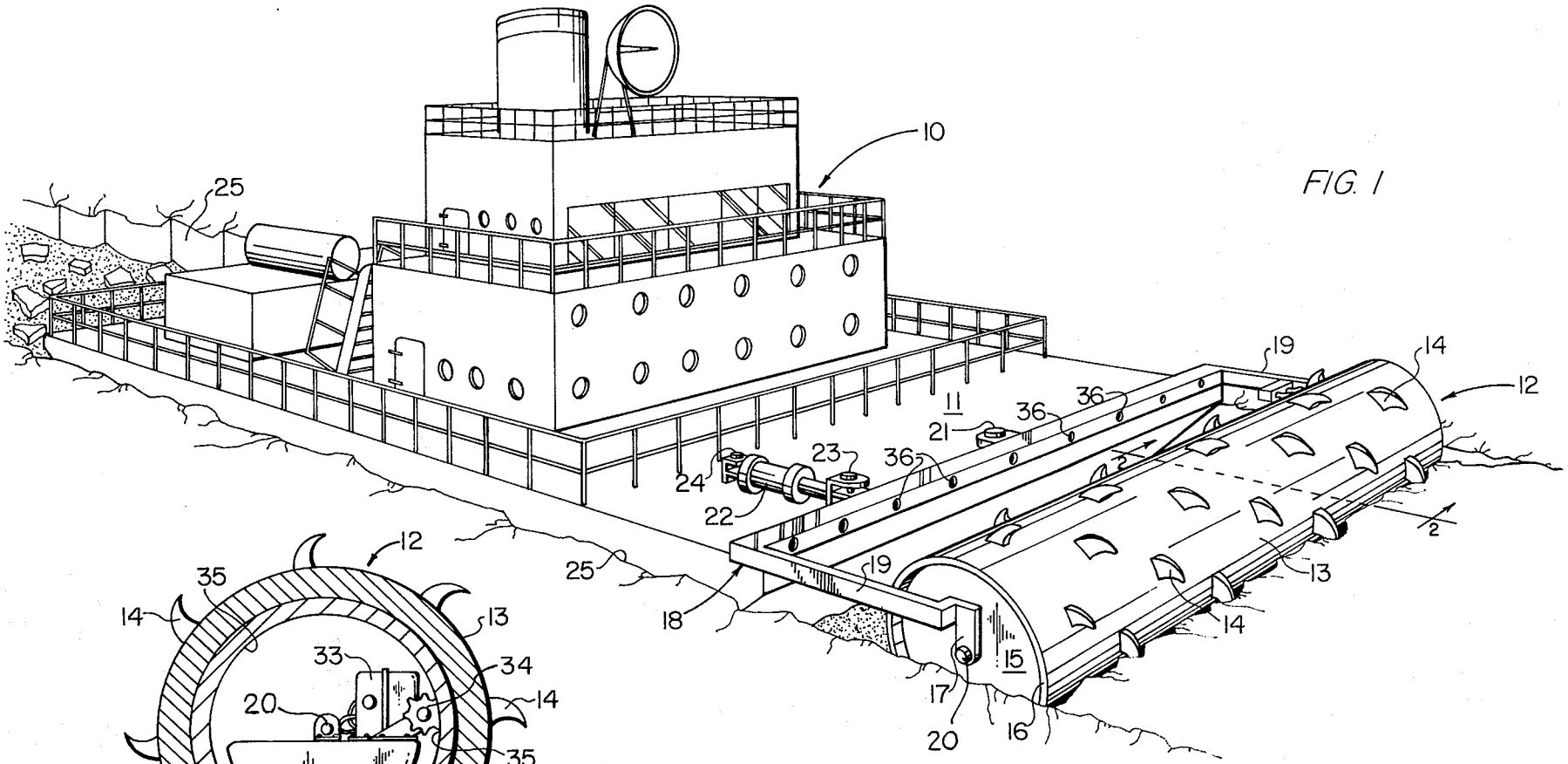
FIG. 1 is a perspective view of a tug vessel and the ice cutting drum of the present invention.

Referring to FIG. 1, there is shown a perspective view of a tug vessel 10 having mounted to the front thereof an ice cutting drum 12 constructed in accordance with the invention. The vessel 10 may comprise a relatively conventional ocean going tug having a bow and front deck 11 which is adapted for mounting the drum. The ice cutting drum 12, comprises a metal cylinder 13 having a plurality of elongate pointed teeth 14 attached to the outside surface. The drum 12 is mounted for rotation about its longitudinal axis and floats of its own buoyancy. The flat end surfaces 15 of the drum 12 are recessed from the outer edges 16 to accomodate bearing and seal members 17 at both ends. The bearing members 17 serve to rotatably mount the drum 12 between the ends of a generally U-shaped framework 18 which is pivotally attached to a pin 21 located on the front of the tug 10. The framework 18 is hollow and includes a transverse member and a pair of forwardly extending side arms 19 which lie above the upper surface of ice sheet and outside the sides of the channel 25 being formed. The ends of the arms 19 project downwardly and inwardly to the bearing and seal members 17. The frame 18 is moved about the pivot pin 21 by means of external power such as the hydraulic cylinder 22. One end of the cylinder 22 is pivotally attached to the frame at 23 and the other end is pivotally attached to the tug deck 11 at pin 24. Actuation of the cylinder 22 by conventional hydraulic lines and controls (not shown) changes the angle of the drum 12 with respect to the tug 10 and thereby steers the drum in the desired direction of travel. Both pins 21 and 24 are arranged in a conventional manner to permit independant vertical movement of the buoyant drum 12 with respect to the tug 10.

The length of the drum 12 is greater than the width of the tug 10 in order to form a path through the ice with sufficient width for adequate clearance of the sides of the tug. Further, the tug 10 includes rearwardly tapered sides and is slightly narrower at the rear than at the front so that in the event any chunks or large ice pieces become stuck between the tug 10 and the sides of the channel 25 the ice will loosen as the tug moves on through the channel.

The drum 12 is preferably formed from relatively thick sheet steel. The size of the drum 12 may be on the order of 100 feet long and 30 feet in diameter. The elongate teeth 14 may be on the order of 3 feet long and are preferably shaped from steel bar stock about 6 inches thick.

Figure 2:
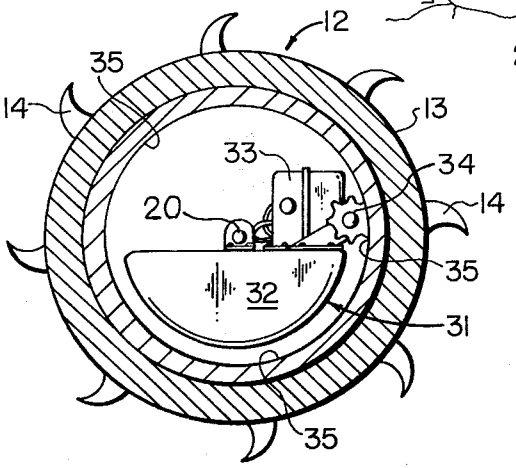
FIG. 2 is a cross section view of the drum taken about the lines 2—2 of FIG. 1.

Referring now to FIG. 2, there is shown a cross section view of the drum. Mounted for free movement about the longitudinal axis of the drum 12 is an inertial weight 31. The inertial weight 31 preferably comprises a fuel tank 32. As fuel is used from the tank 32 it is refilled with water so that the tank serves continuously as a ballast means. By controlling the weight of the ballast, and hence the depth of flotation of the drum, the angle of attack of the teeth 14 upon the ice surface may be varied for optimum cutting. The top surface of the weight 31 may also serve as a mounting platform for self-contained, internal power source 33, such as a gas turbine engine. The controls mechanisms and the intake and exhaust ducts for the engine 33 are preferably carried by hollow arms of the support framework 18. In one illustrative embodiment, the engine 33 is connected by means of a gear 34 and an internal ring gear 35 to rotate the cylinder 13 against the torque generated by the inertial counterweight 31. In another embodiment the internal power source 33 may comprise one or more electric motors driven by a generator located on the tug 10 and connected via cables through the hollow arms of the framework 18. It should be clear that power from the source 33 may be coupled to rotate the drum 12 in a number of different fashions and the embodiment shown herein is merely exemplary.

Referring to both FIGS. 1 and 2, the drum 12 is rotated by the power source 33 and is brought into contact with the edge of an ice sheet by the tug 10. As the drum 12 is rotated, the teeth 14 impinge upon the surface of the ice and the drum 12 tries to crawl up onto the ice sheet. The sheer weight of the massive drum 12 causes a small ribbon of sheet ice to flex and project downwardly into the water beneath the drum. As the ice ribbon projects more downwardly, it is cut through by the teeth 14 and the freed ice chunk is moved beneath the drum and away. The teeth 14 are elongate and extend forwardly out onto the ice sheet sufficiently far that the sheet will be attacked at an optimum distance from the edge, as the drum 12 continues to try to crawl up onto the sheet.

As mentioned above, in one embodiment of the invention the power source 33 may comprise a gas turbine engine. The exhaust from the gas turbine is preferably ducted out one end of the cylinder 13, for example, through a hollow arm of the U-shaped framework 18, and exhausted into the atmosphere through a plurality of ports 36 formed on the inner front edge of the framework 18. The hot exhaust gases surround the drum 12 and the area between the front of the tug 10 and the drum 12. Moreover the exhaust gases may be used to form a warm air shroud about the system and prevent the rapid refreezing of the ice pieces when they come in contact with the ambient air which may often be at temperatures on the order of 50°–60° below 0° F.

Referring now to FIGS. 4 and 5 there are shown a pair of tugs 40 and 41 equipped with drums 12 constructed in accordance with the present invention. By arranging the tugs with adjacent or overlaping cutting paths, a channel may be formed through the ice of sufficient width to move the drilling barge 42. The hull of the barge 42 may be of the type which floats with a relatively shallow draft. For example, the barge 42 may be similar to those used for drilling in the southern United States swamp areas, such as Louisiana. It may, however, be necessary to reinforce the barge to withstand arctic ice pressures. The barge 42 has mounted thereon a conventional drilling rig 43 and the required accompaning equipment.

As illustrated in FIG. 4, the drilling barge 42 may be towed through a channel formed in the arctic ice to a location where it is desired to drill a well. As illustrated in FIG. 5, once the drilling barge 42 is in position, it is disconnected from the tugs 40 and 41, anchored to the sea bottom at that location and allowed to freeze into the surrounding ice. Once the barge 42 is in position, the tugs and ice cutting drums 40 and 41 are used to cut an annular channel 44 about the drilling barge 43 to isolate an ice island 45 from the surrounding ice field 46. Thus, the surrounding ice sheet 46 can move a distance up to the width of the channel 44, which may be on the order of one hundred feet, before its movement would affect the position of the ice island 45 and the drilling barge 42 located within. It is necessary to either periodically or continuously operate the tugs and drums 40 and 41 to keep the channel 44 open. Further, the tugs 40 and 41 may be used as living quarters for the drilling crew while operations are conducted.

Once the well is completed by the rig 43, the barge 42 is simply cut free from the surrounding ice and moved from the location by the tugs 40 and 41 in the same manner it was originally placed in position. Further, drum equipped tugs can be used to move oil barges through the arctic ice to and from the completed well and carry the oil to market.

Referring finally to FIG. 6, it may be seen that in transporting the drum 12 to arctic waters, it can be disengaged from the front of the tug 10 and towed longitudinally through the clear water to reduce the drag forces on the tug.

In summary, it is apparent from the foregoing description that the invention provides an effective means of moving vessels through ice sheets in frozen arctic waters and for performing operations above a submerged marine location during the presence of a periodically moving sheet of ice.

The structural and procedural aspects of the invention have been described above with reference to certain preferred embodiments of the invention, which have been selected from the many embodiments which the invention might take, for purposes of example and illustration. Persons skilled in the art and technology to which this invention pertains will recognize that the specific structures and procedures described may be modified or altered somewhat while still utilizing the advances and improvements provided by the invention. Accordingly, the foregoing description should be regarded as explanatory and illustrative, rather than limiting of the scope of the invention.

What is claimed is:

1. A system for attachment to the front of a buoyant vessel for forming a channel to move the vessel through a sheet of ice, comprising:

a hollow buoyant drum extending transversely of the desired direction of channel formation and having a plurality of teeth projecting from the outer surface thereof;

a hollow framework mounting said buoyant drum for rotation about its longitudinal axis, said framework including openings along the inner periphery thereof;

a power source mounted within said drum; the exhaust heat from said power source being connected for discharge into the atmosphere through the framework openings to provide a warm air shroud in the region of said drum and inhibit refreezing of the ice pieces in the channel; and means for coupling said power source to said drum to rotate the drum and the teeth into contact with the surface of an ice sheet and form a channel the width of the drum therethrough.

2. A system for forming a channel through a sheet of ice comprising:

a buoyant vessel;

a hollow framework having a transverse member and a pair of forwardly extending arms pivotally attached to the front of the vessel, said framework having a plurality of openings along the inner surface of the transverse member;

a buoyant drum rotatably mounted about its longitudinal axis between the arms of said framework and extending transversely of the direction of movement of said vessel;

said drum including a plurality of teeth extending outwardly therefrom;

an inertial counterweight mounted within said drum for free rotation about the longitudinal axis thereof;

a power source, including a gas turbine engine, mounted within said drum and attached to said inertial counterweight;

the exhaust gases from said engine are connected through said hollow framework to exit through the openings therein and form a warm air shroud around the drum to inhibit refreezing until the drum has passed; and means for coupling power from said source to said drum to rotate the drum about its axis against the force of said inertial counterweight and bring the teeth into contact with the surface of an ice sheet to cut the ice and form a channel the width of the drum therethrough.

* * * * *

UNITED STATES PATENT OFFICE

CERTIFICATE OF CORRECTION

PATENT NO. : 3,965,835

DATED : June 29, 1976

INVENTOR(S) : John D. Bennett

It is certified that error appears in the above-identified patent and that said Letters Patent are hereby corrected as shown below:

Change Assignee to Sun Oil Company (Delaware) instead of Sun Oil Company.

Signed and Sealed this

Seventh Day of September 1976

[SEAL]

*Attest:*

RUTH C. MASON
*Attesting Officer*

C. MARSHALL DANN
*Commissioner of Patents and Trademarks*